US008238769B2

(12) United States Patent
Soures

(10) Patent No.: US 8,238,769 B2
(45) Date of Patent: Aug. 7, 2012

(54) ELECTROSTATIC DISTURBANCE USED IN A TIMING ROUTINE FOR HVPS SWITCHING IN A PRESSURE TRANSFER SYSTEM INVOLVING BTB OR BTR

(75) Inventor: Michael N. Soures, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 379 days.

(21) Appl. No.: 12/632,925

(22) Filed: Dec. 8, 2009

(65) Prior Publication Data

US 2011/0135329 A1 Jun. 9, 2011

(51) Int. Cl.
*G03G 15/16* (2006.01)

(52) U.S. Cl. ..... 399/31; 399/66

(58) Field of Classification Search ..... 399/31, 399/49, 66, 313, 314
See application file for complete search history.

(56) References Cited

U.S. PATENT DOCUMENTS

| | | | | |
|---|---|---|---|---|
| 5,680,541 | A * | 10/1997 | Kurosu et al. | 714/26 |
| 6,654,570 | B2 * | 11/2003 | Kato | 399/66 |
| 6,845,224 | B1 * | 1/2005 | Gross et al. | 399/316 |
| 7,257,359 | B2 * | 8/2007 | Soures et al. | 399/316 |
| 2007/0196115 | A1 * | 8/2007 | Soutome | 399/16 |
| 2008/0199196 | A1 * | 8/2008 | Cook | 399/66 |
| 2010/0329715 | A1 * | 12/2010 | Tsukamura et al. | 399/66 |

FOREIGN PATENT DOCUMENTS

| | | | |
|---|---|---|---|
| JP | 2000003104 | A * | 1/2000 |
| JP | 2007025353 | A * | 2/2007 |

* cited by examiner

*Primary Examiner* — Robert Beatty
(74) *Attorney, Agent, or Firm* — Oliff & Berridge, PLC

(57) ABSTRACT

This disclosure is directed to systems and methods for calibrating, to a higher level of precision, the timing of operation of a bias transfer element in an image forming device. Specifically, the systems and methods are directed to calibrating the timing of forward and reverse biasing in a document processing apparatus to account for myriad mechanical and environmental disturbances.

17 Claims, 5 Drawing Sheets

ELECTROSTATIC DISTURBANCE USED IN A TIMING ROUTINE FOR HVPS SWITCHING IN A PRESSURE TRANSFER SYSTEM INVOLVING BTB OR BTR

BACKGROUND

This disclosure is directed to systems and methods for recalibrating the timing of operation of a bias transfer element in an image forming device. Specifically, the systems and methods are directed to calibrating the timing of forward and reverse biasing in a document processing apparatus.

Bias transfer elements directly support the transfer of a developed toner powder image from a photoconductive member. A bias transfer element is an element that uses electric charge to attract or repel a substance. Bias transfer elements may transfer a developed toner powder image from a photoconductive member by creating a charge that attracts the toner from the photoconductive member onto a substrate. The process of attracting a substance toward the bias transfer element may be referred to as forward biasing. Similarly, the process of repelling a substance from the bias transfer element may be referred to as reverse biasing. Forward and reverse biasing the bias transfer element are examples of activating the bias transfer element. Bias transfer elements may include bias transfer rolls (BTRs) and bias transfer belts (BTBs).

Due to varying electrostatic forces involved with the transfer process, stray toner and debris particles may adhere to the surface of the transfer support member. Consequently, image quality deteriorates. There is a need, therefore, to clean the surface of the transfer support member to prevent degradation of the quality of subsequent copies and/or to prevent toner particles from being fused to, for example, the backside of the final support sheet. Typical cleaning methods include wiping with a brush, a web, a blade, a magnetic brush, or using an airflow, or a combination of these.

In order to deliver a lower unit manufacturing cost and reduce complexity for office and production markets, cleaning implementation for the bias transfer element may include reverse biasing while using the intermediate transfer belt or photoreceptor belt cleaner to remove toner or contamination. Intermediate transfer belts, photoreceptor belts and photoconductive belts in general are examples of "the belt" described throughout the remainder of this application. One problem associated with the use of reverse biasing in conjunction with the belt cleaner is that the use of reverse biasing involves sensitive timing to reverse bias the belt in inter-document zones, i.e. zones of the belt between transfer regions of the belt, which are those areas designated for image transfer. The reverse bias is applied in the inter-document zones to avoid contamination. The timing is critical to effect cleaning while ensuring that the bias transfer element correctly biases in the transfer regions for transfer of an image to a substrate. With advancing technology, the size of these inter-document zone is decreasing and the speed of the belt is increasing. For example, certain current xerographic image forming systems have inter-document zones of less than 40 mm, with photoreceptor belt or drum speeds of 600 mm per second and higher. As the size of the inter-document zone decreases and the speed of the belt increases, the difficulty with precisely timing the forward and reverse biasing of the bias transfer element to accomplish cleaning becomes particularly acute.

The changing of an attribute of the belt, or a substrate on the belt, caused by close proximity between an activated bias transfer element and the belt may be referred to as engagement between the bias transfer element and the belt. For example, engagement between the bias transfer element and the belt may cause a change in an amount of charge or toner on the belt.

Problems associated with the difficulty of precisely timing the forward and reverse biasing of the bias transfer element can be generated from a number of sources. For example, over the life of the image forming device, various mechanical disturbances and other changes due to, for example, normal wear and tear of the machine, may introduce imprecisions and inaccuracies in the timing of activation of forward and reverse biasing. Environmental factors in the vicinity of the image forming device, such as changes in relative humidity and temperature, may separately introduce, or otherwise add to, such imprecisions and inaccuracies in the timing of activation of forward and reverse biasing. Variations in the composition and characteristics of the transfer substrate, such as, for example, noise attributed to paper type, resistivity or flatness, can also introduce or increase errors. The dimensional stability of the various mechanical components of the device, as well as the electrostatic effects of the device, can be adversely affected. As these errors creep into the device's operation, and the timing of forwarding and reverse biasing begins to drift away from nominal, desired or acceptable values, there is a need to correct or compensate for these errors by recalibrating, to a higher level of precision, the timing of activation of forward and reverse biasing.

SUMMARY

In view of the above shortfalls, it would be advantageous to provide a capability by which a document processing apparatus could automatically detect, with precision, the location on the belt where biasing by the bias transfer element has been applied. The document processing apparatus may then automatically recalibrate the timing of forward and reverse biasing based on the detected previous timing.

It would be advantageous to have a system and method to allow a document processing apparatus to determine the timing at which the forward and reverse biasing of a bias transfer element is being applied to a belt. It may be desirable to determine the timing for engaging the bias transfer element with or without a substrate for producing a user-requested image. Determining the timing without engaging the bias transfer element with the substrate avoids the unnecessary waste of a substrate, and may also present advantages in terms of more easily detecting the engagement between the bias transfer element and the belt. It is also desirable that the document processing apparatus be able to recalibrate the timing of activating the bias transfer element in real time without halting movement of the belt.

In various exemplary embodiments, the systems and methods according to this disclosure may provide a capability by which a forward bias is applied by a bias transfer element to a belt. Once the activated bias transfer element is engaged with the belt, an effect caused by the engagement may be analyzed. The effect may be, for example, an edge in a toner patch indicating the change from the drawn toner patch to an approximately bare belt caused by the forward biasing. A timing of the engagement between the bias transfer element and the belt may then be determined based on the analysis. An objective is to learn the timing of engagement between the bias transfer element and the belt, and to then recalibrate the system to a higher level of precision for future timing of activating forward biasing when substrates pass the bias transfer element.

In various exemplary embodiments, the forward bias may be activated when the bias transfer element is in close proximity to the belt. The activation of forward bias may occur in an inter-document zone or in a transfer zone. The bias transfer element may reverse bias before and after the application of forward bias in order to clean the bias transfer element as discussed below.

In various exemplary embodiments, toner may be pulled from a belt onto a substrate by forward and reverse biasing the bias transfer element in a transfer zone. An edge at which an amount of toner on the substrate changes may then be sensed. The timing of the engagement between the bias transfer element and the belt may then be determined based on the location of the sensed edge. In this manner, the various error producing effects can be accounted for. Engagement with the bias transfer element may be adjusted to account for, for example, noise associated with paper type, resistivity and/or flatness.

In various exemplary embodiments, a toner patch may be drawn on a belt in an inter-document zone. An edge may then be sensed at which an amount of toner in the toner patch changes. The timing of the engagement between the bias transfer element and the belt may then be determined based on the location of the sensed edge.

In various exemplary embodiments, an edge may be sensed at which an amount of charge on the belt changes. The timing of the engagement between the bias transfer element and the belt may then be determined based on the location of the sensed edge.

These and other features and advantages of the disclosed systems and methods, are described in, or apparent from, the following detailed description of various exemplary embodiments.

BRIEF DESCRIPTION OF THE DRAWINGS

Various exemplary embodiments of disclosed systems and methods for automatic recalibration, to a higher level of precision, of timing for activation of a bias transfer element will be described, in detail, with reference to the following drawings wherein.

DETAILED DESCRIPTION OF EMBODIMENTS

The following embodiments illustrate examples of systems and methods for recalibrating the timing of activating a bias transfer element in a document processing apparatus by detecting the timing of engagement between the bias transfer element and a belt. The following description of various exemplary embodiments may refer to one specific type of image forming device, such as, for example, an electrostatic or xerographic image forming device, and discuss various terms related to image production within such an image forming device, for the sake of clarity, and ease of depiction and description. It should be appreciated, however, that, although the systems and methods according to this disclosure may be applicable to such a specific application, the depictions and/or descriptions included in this disclosure are not intended to be limited to any specific application.

In referring to, for example, image forming devices as this term is to be interpreted in this disclosure, such devices may include, but are not limited to, copiers, printers, scanners, facsimile machines and/or xerographic image forming devices.

Figure 1:
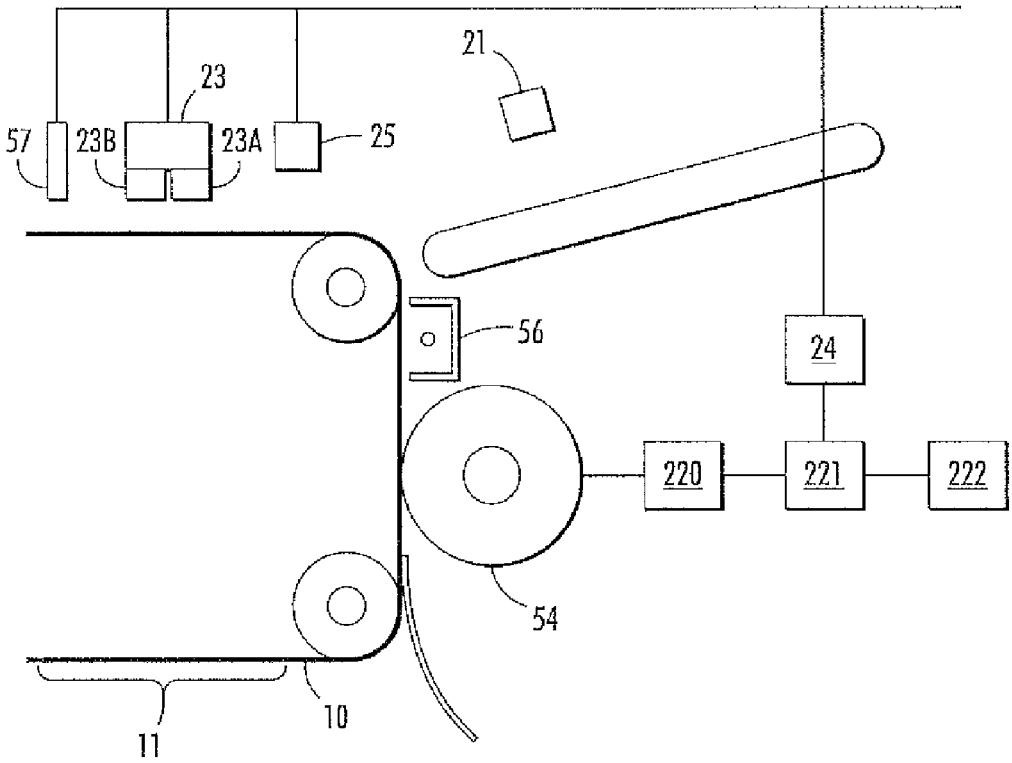
FIG. 1 illustrates an exemplary document processing apparatus according to this disclosure.

FIG. 1 illustrates an exemplary bias transfer element within a copy transfer section of an electrostatographic imaging device. As noted above, many varieties of bias transfer elements are possible, and this embodiment is exemplary only, Copy substrate 14 is pressed against photoreceptor belt (PR) 10. Bias transfer roll (BTR) 54 charges the copy substrate sufficiently to urge toner particles to transfer from PR 10 to copy substrate 14, as discussed below. Upon exiting the transfer section, corotron 56 provides an opposite charge, thereby aiding the detacking of copy substrate 14 from PR 10.

PR 10 can alternatively be any charged imaging surface useful in electrostatographic imaging, including such surfaces as photoreceptor drums or electrostatic dielectric surfaces.

BTR 54 is a bias transfer element, as described above, in the form of a roll. The BTR 54 is positioned in close proximity to the PR 10 so that the copy substrate 14 may pass through a nip formed between the BTR 54 and the PR 10. As the copy substrate 14 passes the BTR 54, the BTR 54 may be forward biased to attract a developed toner powder image from the PR 10 onto the copy substrate 14. At other times, the BTR 54 may be reverse biased to repel any toner or contamination from the BTR 54 onto the PR 10. The repelled toner or contamination may then be removed by a cleaning mechanism, including cleaning blade 57.

Prior to arrival at the BTR 54, a half-tone image may be developed in a region 11 of PR 10. The half-tone image may be in any pattern and in any percentage of coverage sufficient for subsequent detection of toner removal when the developed area is subject to forward bias by the BTR 54, as described below. Area coverage of between about 20 and about 80% would typically be used, and, preferably, area coverage between about 40 and about 60%.

Region 11 may be placed in any region of PR 10 that is not reserved for transferring an image to a copy substrate. These regions may include inter-document zones, which may be located between document pitches, in skipped pitch areas, or anywhere during PR 10 rotation sequences when no copy output is intended. A preferred area for placement of region 11 is in the seam area of PR 10 since such a seam area is typically not used for imaging purposes due to unreliability of images across the seam.

An area coverage sensor system 23 may also be provided. For a typical monochrome sensor, this sensor system 23 may be an electronic toner area coverage sensor (ETAC). Such an ETAC will be discussed as an example of sensor system 23. As shown in FIG. 1, sensor system 23 is typically disposed between the corotron station 56 and cleaning blade 57. ETACs are used in modern printers and copiers to monitor and correct image quality issues by measuring toner darkness at various percentages of imaged coverage. For instance, a printing system may periodically check image quality by developing on the PR 10 half-tone images in inter-document zones at such intensities as 0, 12, 50, 88 and 100% half-tone coverage. Since such half-tone regions occur in inter-document zones, no transfer to copy substrates occurs, and the developed image proceeds on PR 10 past sensor system 23 until removed from PR 10 by cleaning blade (or brush) 57.

The exemplary sensor system 23 shown in FIG. 1 comprises a light source 23*a* and a sensor array 23*b* for detecting light reflected off of the underlying substrate. The wavelength emitted by light source 23*a* is generally selected for optical reflection (or absorption) by the toner being measured. The greater the area of toner coverage, the greater (or lesser) the reflection detected by sensor 23*b*. In the exemplary embodiment shown, sensor 23*b* detects reflected photons by emitting one or more electrons for each photon received. The result is a variable voltage signal with an increase (or decrease) in voltage signifying more (or less) reflected light, which, in turn, indicates greater (or lesser) area coverage by toner. By comparing the actual voltage signal to the signal predicted in response to the percentage of half-tone coverage, processor 221 may be used to determine if the amount of toner actually developed is less than or greater than predicted amounts. The processor 221 may include a memory 222 for storing program instructions for executing all or part of the methods disclosed in this application. In response to variations outside of specified amounts, corrective measures may be undertaken to bring the amount of the developed image within specifications.

The system of FIG. 1 may operate in the following manner to provide the recalibration, to a high level of precision, of the timing of BTR activation according to one exemplary embodiment (methods of operation according to this disclosure are also described in detail below with respect to FIGS. 6-8). The system of FIG. 1 may develop region 11 at a position on PR 10 that is not reserved for transfer of an image to a copy substrate. The system may save information indicating the precise location of the region 11 on the PR 10. The region 11 may serve as a surrogate for a copy substrate, as discussed below. Prior to the region 11 passing the BTR 54, the BTR 54 may be reverse biased to repel toner and contamination from the BTR 54 to the PR 10, thereby cleaning the BTR 54. The system of FIG. 1 may estimate the time at which the region 11 will begin to pass the BTR 54. At the estimated time, the system may control the BTR 54 to stop activation of reverse bias and to begin activation of forward bias. The activation of forward bias will attract toner from the region 11 onto the BTR 54. When the region 11 completely passes the BTR 54, toner will cease to be attracted from the region 11 onto the BTR 54. Thus, if the length of region 11 on the PR 10 is greater than the length of the area on the PR 10 engaging with the BTR 54, a portion of the toner inside of the region 11 will be removed.

After passing the BTR 54, the region 11 may proceed toward the sensor system 23. The sensor system 23 may detect an amount of toner on the PR 10. Thus, when the region 11 passes the sensor system 23, the sensor system 23 may detect a first edge, indicating a change from the bare belt on the PR 10 to the beginning of the region 11. The sensor system 23 will continue to detect the toner on the region 11 until meeting a second edge, which indicates the point at which the BTR 54 had begun to engage with the PR 10, thereby removing toner from the region 11. Thus, the sensor system 23 may detect a second edge indicating a change from toner in the region 11 back to an approximately bare belt. As the region 11 continues to pass the sensor system 23, the sensor system 23 will continue to detect the approximately bare belt for the length on the PR 10 where the BTR 54 engaged with the PR 10. At the end of that period, the sensor system 23 may detect a third edge, indicating a return from the approximately bare belt to an indication of toner on the PR 10. This second indication of toner corresponds to the other end of the region 11 outside of the portion, within the region 11, where the BTR 54 engaged with the PR 10. The sensor system 23 will continue to detect toner from the region 11 until detecting a fourth edge, indicating a change from toner to the bare belt. The fourth edge indicates the end of the region 11. In this manner, the sensor system 23 measures a signal on the PR 10 when running without and with substrates present. Separately, there may be a sensor 21 used in the paper path from which an inverse signal may be measured from the substrate when present. There may also be instances when an entire image (region 11) is transferred to BTR 54 and then in absence of substrate subsequently passed through a transfer nip again in contact with PR 10 with reverse biasing pulsed at different levels to push toner back onto PR 10 for analysis with an ETACS sensor. In this way, timing necessary for reverse biasing can potentially be ensured across BTR 54 length variation to ensure timing for a cleaning cycle to be completed, or otherwise to evaluate timing of pushing toner off the BTR 54 for comparison against analysis of instances when toner is pushed off the PR 10.

The above discussed operation of the system of FIG. 1 allows the system to recalibrate, to a higher level of precision, the timing of activation of the BTR 54, in the following manner. The system of FIG. 1 may use the region 11 as a surrogate for a copy substrate. By detecting the precise timing at which the BTR 54 engages with the region 11, the system may calculate the timing at which the BTR 54 would engage with a copy substrate corresponding to the region 11. The system may then analyze the edges detected by the sensor system 23 to determine whether those edges are within specifications. The specifications may be formed to ensure that the BTR 54 would be forward biased only while a copy substrate passes the BTR 54, and not when a copy substrate is not present beneath the BTR 54. Similarly, the specifications may ensure that the BTR 54 would only be reverse biased when a copy substrate is not present beneath the BTR 54. By ensuring that the BTR 54 only applies forward bias when the copy substrate is present, the system can ensure that the BTR 54 does not attract excess or unnecessary toner or contamination from the PR 10 onto the BTR 54. Similarly, by ensuring that the BTR 54 only applies reverse bias when a copy substrate is not present beneath the BTR 54, the system can ensure that no toner or contamination is repelled onto the backside of a copy substrate.

The specifications indicating that the edges detected by the sensor system are desirable, or within acceptable values, may be based on testing a machine operating within acceptable conditions. The machine operating within acceptable conditions may be used to draw and analyze a region, such as region 11, as discussed above, and also to draw an image on a copy substrate. The system may correlate the detected edges in the region with the timing of activating the BTR 54. The specifications may indicate acceptable values for the detected edges in the region correlating with acceptable image output on the copy substrate. For example, if the image drawn on the copy substrate is shifted slightly from a desirable location, then the edges detected by the sensor system 23 may be correspondingly shifted to determine the specification values. It should be noted that the specific parameter measured may be dependent on the type and placement of the sensor. As a non-limiting example, measuring substrate shift may be accomplished when monitoring PR 10 with sensor system 23.

Differently, for substrate monitoring with sensor 21 along the paper path, it may be more appropriate or advantageous to measure size of a transferred zone.

During operation, the timing of operation of the BTR 54 may gradually, or otherwise, decrease in precision and accuracy. Accordingly, the system may, in real time or otherwise, develop a region 11 and pass the region 11 past the BTR 54 and sensor system 23, as discussed above, detecting edges corresponding to engagement between the BTR 54 and the belt. The system may then recalibrate, to a higher level of precision, the timing of activation of the BTR 54 based on the detected edges.

Figure 2:
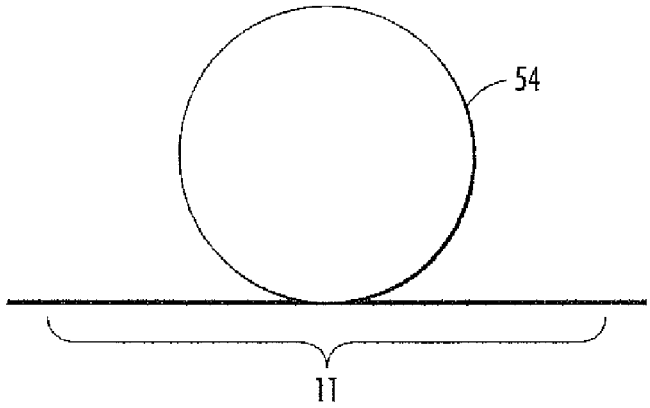
FIG. 2 illustrates an exemplary engagement between a bias transfer element and a belt.

FIG. 2 illustrates how the region 11 may pass under the BTR 54 as the PR 10 moves toward the area coverage sensor system 23. As the region 11 passes the BTR 54, processor 221 instructs the BTR 54 to activate forward bias, thereby attracting toner from the region 11 onto the BTR 54. Before and after activating the forward bias as the region 11 passes the BTR 54, processor 221 may instruct the BTR 54 to activate reverse bias. The reverse bias cleans the BTR 54 by repelling toner back from the BTR 54 onto the PR 10 so that toner or contamination repelled from the BTR 54 to the PR 10 may then be removed from the PR 10 by the cleaning blade 57, or any other cleaning mechanism for the PR 10.

The region 11 may be larger than a region of the PR 10 over which the BTR 54 engages with the PR 10. By using a larger region 11, processor 221 may detect both the beginning and the end of the engagement, within the region 11, between the BTR 54 and the PR 10.

Figure 3:
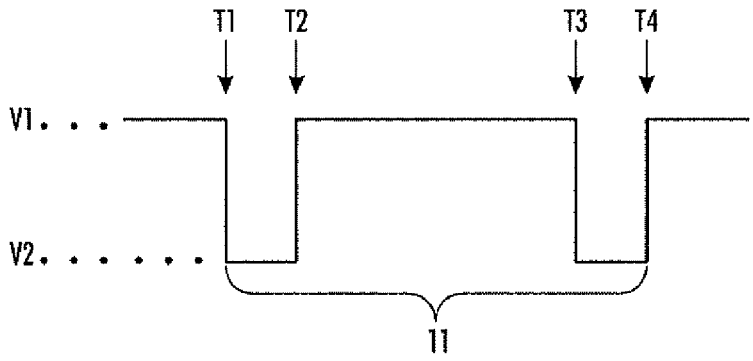
FIG. 3 illustrates a first exemplary detection result, including two detected dips, by a sensor system.
Figure 4:
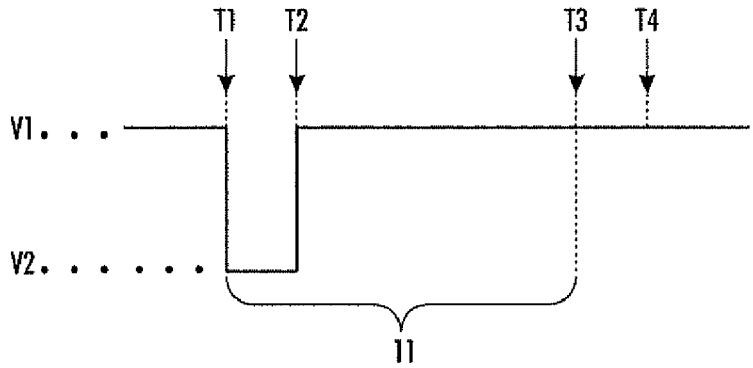
FIG. 4 illustrates a second exemplary detection result, including a first detected dip, by a sensor system.
Figure 5:
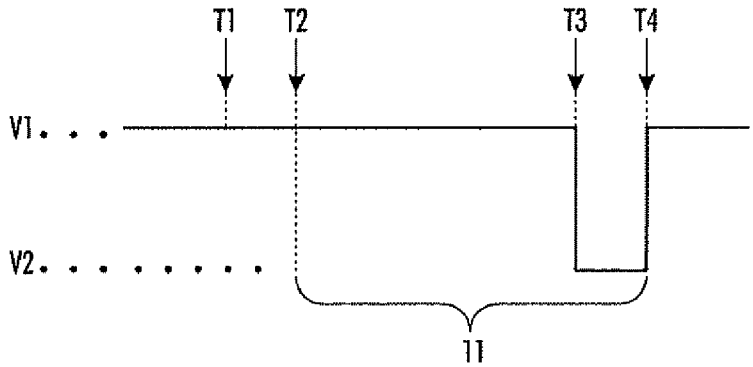
FIG. 5 illustrates a third exemplary detection result, including a second detected dip, by a sensor system.

FIG. 3 illustrates an ETAC voltage signal corresponding to the engagement between the forward biased BTR 54 and the PR 10. The ETAC voltage is graphed versus time. The time dimension, in turn, corresponds to the distance of travel of PR 10 when the PR 10 is in motion at a constant rate as it is during imaging cycles. It should be noted that FIGS. 3, 4 and 5 are idealized graphs because actual measurements show continually varying voltages with steep slopes conforming to the step functions indicated in the idealized graphs.

The ETAC curve in FIG. 3 shows how the influence of the BTR 54 is detected in the middle of the region 11. Before time T1, the sensor system 23 detects a value of V1 volts, which corresponds to a bare belt. At T1, the sensor system 23 detects approximately V2 volts because the beginning of the region 11 begins to pass the sensor system 23. The sensor system 23 detects approximately V2 volts until the time T2, at which point the sensor system 23 detects approximately V1 volts again. The sensor system 23 begins to detect about V1 volts again at time T2, indicating the beginning of the engagement between the BTR 54 and the PR 10. The sensor system 23 detects about V1 volts at time T2, because the forward biased BTR 54 removed substantially all of the toner from that portion of the region 11, so that the portion of the region 11 returned to an approximately bare belt state. The sensor system 23 may not detect the full V1 volts between the times T2 and T3, however, as in times before T1 and after T4, because the BTR 54 may fail to remove 100% of the toner from the patch 11. Accordingly, the sensor system 23 may only detect approximately V1 volts, or a similar value lower than V1, between T2 and T3.

The value V1 may be about 3.5 volts and the value V2 may be about 1.5 volts, but the disclosed system is not limited to systems detecting those values. Rather, the disclosed system may recalibrate timing of activation of forward bias by the BTR 54, if the processor 221 can detect any significant difference between the portions of the region 11 where the BTR 54 engages with the PR 10 (e.g., between T2 and T3) and portions of the region 11 where the BTR 54 does not engage with the PR 10 (e.g., between T1 and T2 and between T3 and T4).

Between T2 and T3, the sensor system 23 continues to detect approximately V1 volts. That period between T2 and T3 corresponds to the engagement between the BTR 54 and the PR 10. At T3, sensor system 23 detects about V2 volts again, indicating the end of engagement between the BTR 54 and the PR 10. The sensor system 23 continues to detect about V2 volts, indicating the toner patch drawn in the region 11, until the end of the region 11 arrives at T4. At T4, the entire region 11 has passed the sensor system 23. The sensor system 23 then detects about V1 volts corresponding to the bare belt.

FIG. 4 shows how the sensor system 23 may detect a beginning, but not an end, of the engagement between the BTR 54 and the PR 10. As in FIG. 3, the sensor system 23 in FIG. 4 detects a dip between times T1 and T2. At T1, the sensor system 23 ceases to detect the bare belt at V1 volts and begins to detect the toner patch drawn in the region 11. At T2, the sensor system 23 ceases to detect the toner in the region 11, and begins to detect an approximately bare belt at about V1 volts, because the BTR 54 has begun to remove the toner from the region 11.

Unlike the situation in FIG. 3, however, the end of the region 11 at T3 does not occur after the end of engagement between the BTR 54 and the PR 10. The BTR 54 continues to be forward biased, thereby removing any toner from the PR 10, including toner in the region 11, up to T4. Because toner was only drawn in the region 11, which ends at T3, no second dip is detected in FIG. 4, as was detected between times T3 and T4 in FIG. 3. Thus, the sensor system 23 does not detect the end of the engagement between the BTR 54 and the PR 10.

FIG. 5 shows a situation similar to that shown in FIG. 4, except that in FIG. 5, the sensor system 23 does not detect the beginning of the engagement between the BTR 54 and the PR 10. The sensor system 23 only detects the second dip between times T3 and T4, but does not detect any first dip between times T1 and T2, for reasons similar to those discussed with respect to FIG. 4. Because the situation in FIG. 5 is similar to that shown in FIG. 4, but in reverse, further description is omitted.

Referring again to FIG. 1, signals from sensor system 23 are typically analog voltage signals. In order to be read by many computers, such signals are first converted to digital signals by an analog-to-digital converter 24. Even if sensor system 23 signals are digital, some data conversion device may be used to convert the signals into a form readable by processor 221. Once converted, signals are sent to processor 221. Processor 221 also receives data from drive device 220 indicating the timing of activation and deactivation signals. Using signals such as those shown in FIGS. 3-5, processor 221 can determine the relationship between the timing of activation and deactivation signals given to drive device 220 and the timing of BTR 54 engagement with and disengagement from PR 10. One embodiment for determining such relationships and making appropriate adjustments to the timing of activation and deactivation signals is shown in FIG. 6.

Figure 6:
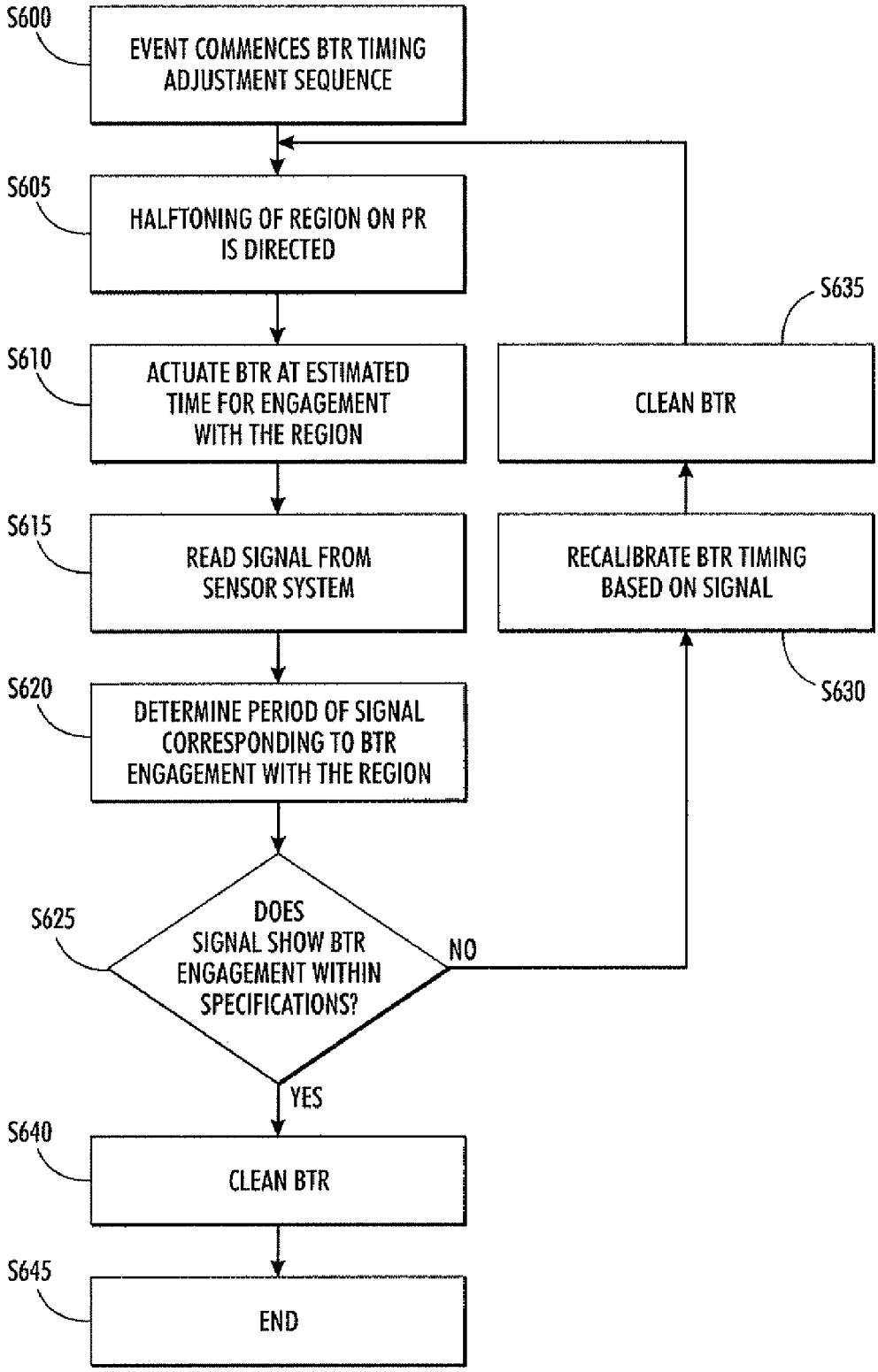
FIG. 6 illustrates a flowchart of a first exemplary method for recalibrating, to a higher level of precision, a timing for activation of a bias transfer element according to this disclosure.

As shown in FIG. 6, operation of the method commences at step S600 upon the occurrence of an event. The event may be based on a lapsed machine run time, number of imaging cycles, calendar time, or any similarly counted event. Commencement of the method may also be initiated by detected events related to machine performance or maintenance such as replacement of the BTR, photoreceptor or other component affecting BTR timing or by detection of imaging defects, including defects caused by faulty timing of BTR engagement or disengagement. Regardless of how the sequence commences, operation of the method proceeds to step S605.

In step S605, the system is directed to draw a half-tone selected region, such as region 11, on a PR. After drawing the toner patch on the region, operation of the method proceeds to step S610.

In step S610, the BTR is activated at an estimated time for engagement with the region. The BTR may be activated by providing a signal to activate the drive device 220. The signal may be given by the processor 221 or by another processor. Operation of the method proceeds to step S615.

In step S615, a sensor system detects the amount of toner in the region on the PR. Operation of the method proceeds to step S620.

In step S620, a processor determines the width of the region based on an analysis of the detection signal from the sensor system. Operation of the method proceeds to step S625.

Step S625 is a determination step in which a determination is made whether the detection signal from the sensor system shows that the BTR engagement with the PR is within specifications.

If in step S625 it is determined that BTR engagement is not within specifications, operation of the method proceeds to step S630.

In step S630, the timing of BTR activation is recalibrated based on the detection signal from the sensor system. For example, if the sensor system detects edges in the region that are shifted from nominal, desired or acceptable positions, the system may accordingly shift the timing of activation of forward bias by the BTR so that, in future operations, the edges will be within specifications. Operation of the method proceeds to step S635.

In step S635, the BTR may be cleaned. From step S635, the method returns to step S605. The method may return to step S605 to run another region past the BTR and the sensor system to confirm that the system is now operating within specifications. Alternatively, if the recalibration process is sufficiently accurate, the recalibration process may be performed once with confidence, without returning to step S605 to confirm that the system is now operating within specifications. That is, the system can return from step S630 to step S640, thereby assuming that the system is now operating within specifications.

If in step S625 it is determined that the BTR engagement is within specifications, operation of the method proceeds to step S640.

In step S640, the BTR is cleaned. The BTR may be cleaned by having the BTR engage in reverse biasing, which repels any toner or contamination from the BTR to the PR. Operation of the method proceeds to step S645 where operation of the method ceases.

Figure 7:
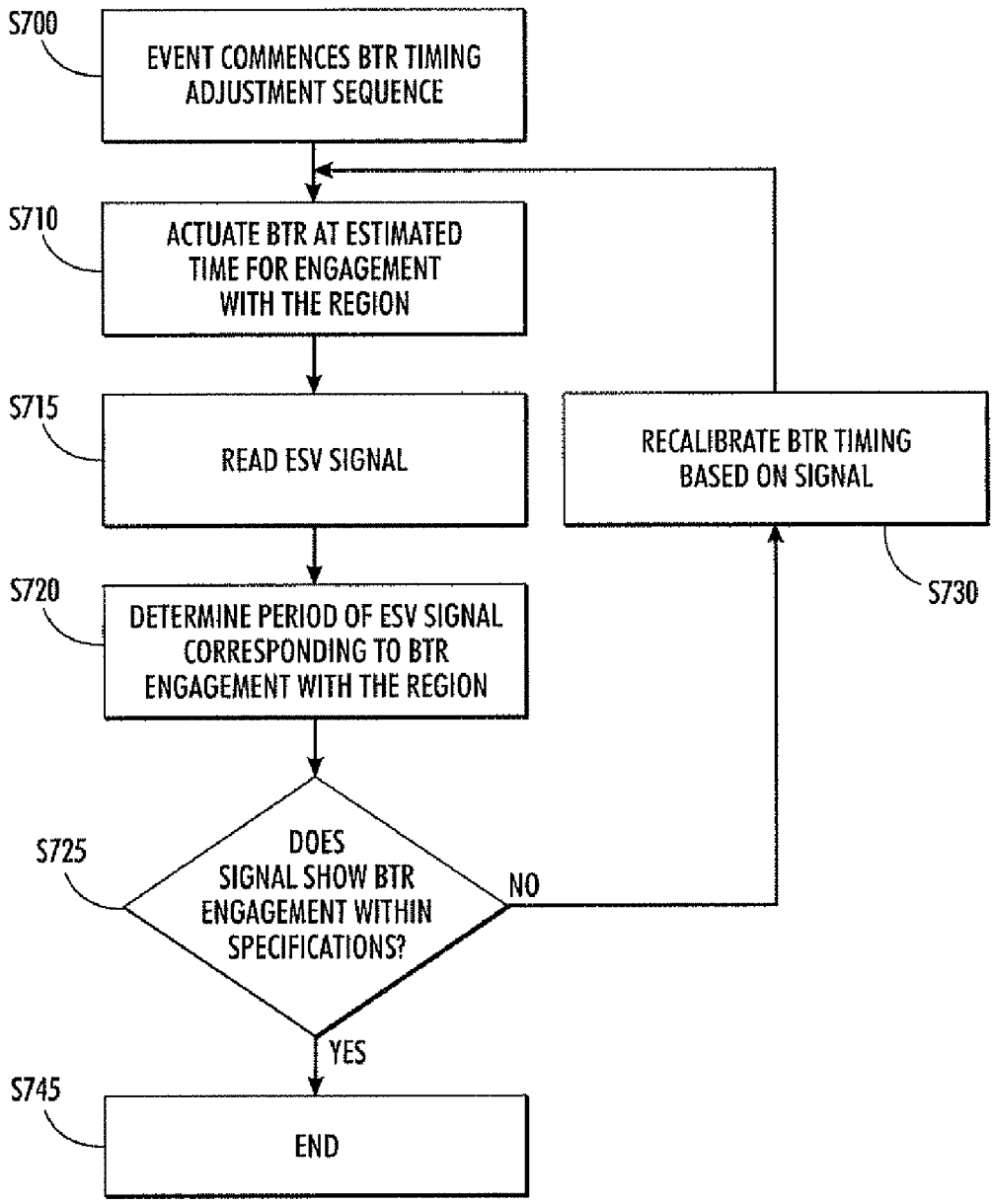
FIG. 7 illustrates a flowchart of a second exemplary method for recalibrating, to a higher level of precision, a timing for activation of a bias transfer element according to this disclosure.

FIG. 7 shows another exemplary embodiment for recalibrating the timing of BTR activation. Like the method shown in FIG. 6, the method in FIG. 7 may measure an effect of engaging the BTR in a region on the PR within an inter-document zone. Unlike the method in FIG. 6, however, the method in FIG. 7 may not draw a toner patch in the region 11. Rather, the method in FIG. 7 detects a change in charge in the region on the PR caused by the BTR. Accordingly, the method of FIG. 7 uses an electrostatic voltage sensor (ESV) 25, as shown in FIG. 1, to detect the change in charge in the region on the PR. Operation of a corotron station, such as corotron station 56, may be halted as the region passes from the BTR toward the ESV, so to not interfere with the detection of the charge on the PR.

The method shown in FIG. 7 is similar to the method shown in FIG. 6 so that elements in FIG. 7 correspond to like elements in FIG. 6 (e.g., element S700 in FIG. 7 corresponds to element S600 in FIG. 6). Unlike FIG. 6, however, the method in FIG. 7 does not include a step S705 of drawing the toner patch in the region 11. Accordingly, the method of FIG. 7 also does not include steps of cleaning the BTR 54 after forward biasing, as in steps S635 and S640 of FIG. 6. Further, because the system of FIG. 7 is based on the ESV sensor 25, and not an ETAC sensor, step S715, S720, S725 and S730 are based on ESV sensor 25 and not an ETAC sensor.

As shown in FIG. 7, operation of the method commences at step S700 upon the occurrence of an event. The event may be based on a lapsed machine run time, number of imaging cycles, calendar time, or any similarly counted event, as discussed above regarding FIG. 6. Regardless of how the sequence commences, operation of the method proceeds to step S710.

In step S710, the BTR is activated at an estimated time for engagement with the region. The BTR may be activated by providing a signal to activate the drive device 220. The signal may be given by the processor 221 or by another processor. Operation of the method proceeds to step S715.

In step S715, an ESV detects the amount of charge in the region on the PR. Operation of the method proceeds to step S720.

In step S720, a processor determines the width of the region based on an analysis of the detection signal from the ESV. The determination may be made by detecting a change in charge on the PR from a portion of the PR where the BTR did not engage with the PR to a portion of the PR where the BTR did engage with the BTR (and/or vice-versa). Operation of the method proceeds to step S725.

Step S725 is a determination step in which a determination is made whether the detection signal from the ESV shows that the BTR engagement with the PR is within specifications.

If in step S725 it is determined that BTR engagement is not within specifications, operation of the method proceeds to step S730.

In step S730, the timing of BTR activation is recalibrated based on the detection signal from the ESV. For example, if the ESV detects edges in the region that are shifted from nominal, desired or acceptable positions, the system may accordingly shift the timing of activation of forward bias by the BTR so that, in future operation, the edges will be within specifications. Operation of the method proceeds to step S710.

If in step S725 it is determined that the BTR engagement is within specifications, operation of the method proceeds to step S745, where operation of the method ceases.

Figure 8:
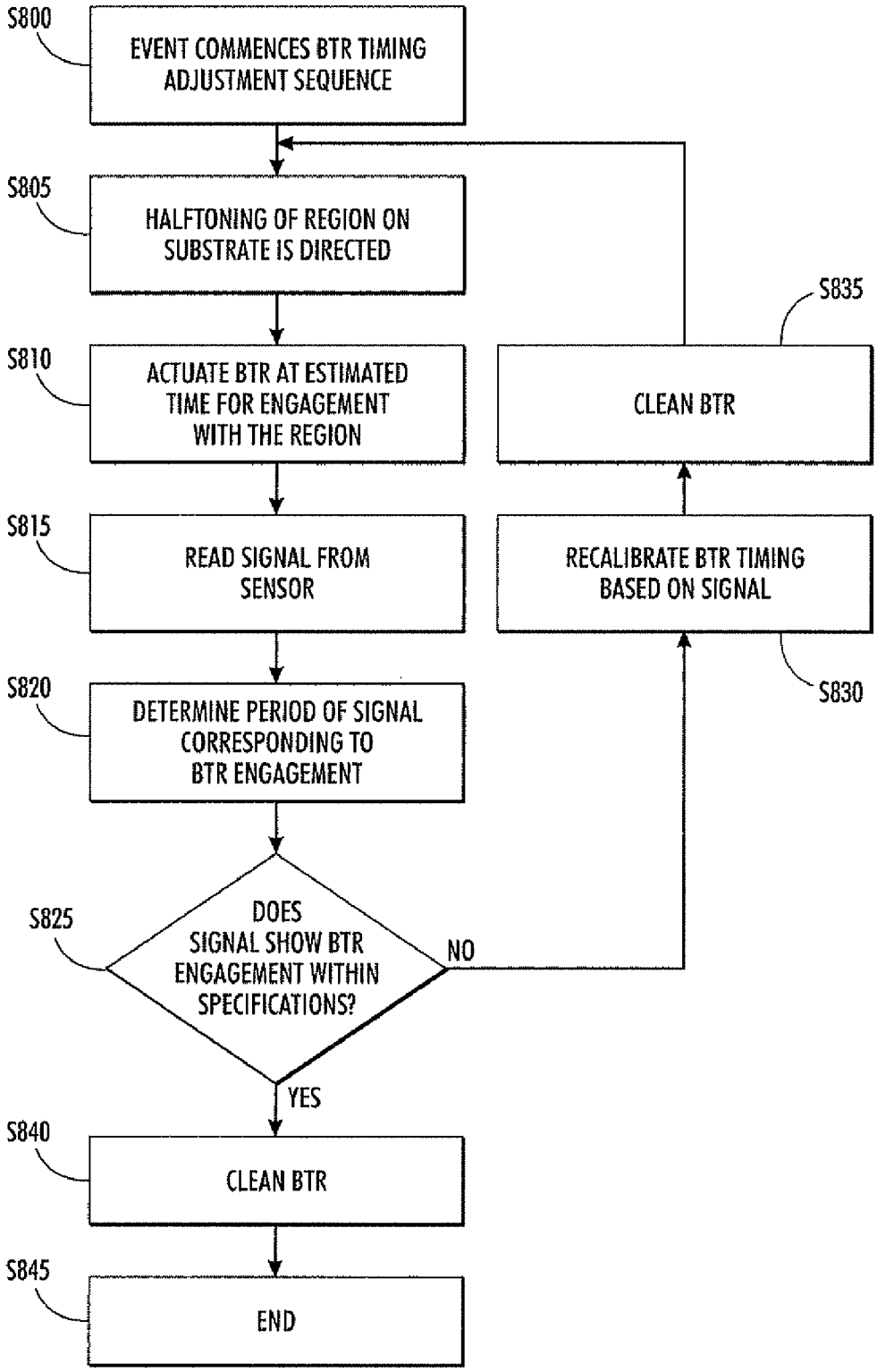
FIG. 8 illustrates a flowchart of a third exemplary method for recalibrating, to a higher level of precision, a timing for activation of a bias transfer element according to this disclosure.

FIG. 8 shows another exemplary embodiment of recalibrating the timing of BTR activation. The method of FIG. 8 is similar to the method in FIG. 6, so that elements in FIG. 8 correspond to like elements in FIG. 6. Unlike the system in FIG. 6, however, the system of FIG. 8 is based on detection of toner drawn on a substrate (e.g., paper) in a transfer zone, rather than based on detection of an amount of toner drawn on a region of the PR in an inter-document zone. The system may use the sensor system 21 shown in FIG. 1. The sensor may be placed anywhere along the paper path where the substrate passes after engagement with the BTR. Accordingly, the detection referenced in steps S815, S820, S825 and S830 may occur using the sensor system 21.

As shown in FIG. 8, operation of the method commences at step S800 upon the occurrence of an event. The event may be based on a lapsed machine run time, number of imaging cycles, calendar time, or any similarly counted event, as discussed above regarding FIGS. 6 and 7. Regardless of how the sequence commences, operation of the method proceeds to step S805.

In step S805, the system is directed to draw a half-tone selected region on a substrate such a paper. After drawing the toner patch on the region of the substrate, operation of the method proceeds to step S810.

In step S810, the BTR is activated at an estimated time for engagement with the region. The BTR may be activated by providing a signal to activate the drive device 220. The signal may be given by the processor 221 or by another processor. Operation of the method proceeds to step S815.

In step S815, a sensor system detects the amount of toner in the region on the substrate. Operation of the method proceeds to step S820.

In step S820, a processor determines the width of the region based on an analysis of the detection signal from the sensor system. Operation of the method proceeds to step S825.

Step S825 is a determination step in which a determination is made whether the detection signal from the sensor system shows that the BTR 54 engagement with the PR 10 is within specifications.

If in step S825 it is determined that BTR engagement is not within specifications, operation of the method proceeds to step S830.

In step S830, the timing of BTR activation is recalibrated based on the detection signal from the sensor system. For example, if the sensor system detects edges in the region that are shifted from nominal, desired or acceptable positions, the system may accordingly shift the timing of activation of forward bias by the BTR so that, in future operation, the edges will be within specifications. Operation of the method proceeds to step S835.

In step S835, the BTR may be cleaned. From step S835, the method returns to step S805. Alternatively, the method may proceed to step S840, thereby assuming that the system is now operating within specifications, as discussed above regarding FIG. 6.

If in step S825 it is determined that the BTR engagement is within specifications, operation of the method proceeds to step S840.

In step S840, the BTR is cleaned. The BTR may be cleaned by having the BTR engage in reverse biasing, which repels any toner or contamination from the BTR to the PR. Operation of the method proceeds to step S845 where operation of the method ceases.

It should be appreciated that although depicted as the PR 10 in FIG. 1, this disclosure contemplates systems in which, instead of, or in addition to, the PR 10, any photoconductor for transporting an image, including an intermediate transfer belt, may be used. Further, although depicted as the BTR 54 in FIG. 1, any biasing element that may attract toner by forward biasing and/or repel toner by reverse biasing may be used, including a bias transfer belt. Further, although the system of FIG. 1 shows engagement between the PR 10 and BTR 54 where an image may be transferred to a substrate, it is not necessary that the interaction occur along a path where a substrate passes. Rather, the interaction between the belt and bias transfer element may occur at a point where an image transfers from one belt to another belt, without the use of a substrate (e.g., from the PR 10 to an intermediate transfer belt).

Any of the data or programs depicted, or alternately described above, including those stored in memory 222, may be implemented using an appropriate combination of alterable, volatile or non-volatile memory, or non-alterable, or fixed, memory. The alterable memory, whether volatile or non-volatile, may be implemented using one or more of static or dynamic RAM, or for example, any computer-readable type media and compatible media reader, a hard drive, a flash memory, or any other like memory medium and/or device. Similarly, the non-alterable or fixed memory may be implemented using any one or more of ROM, PROM, EPROM, EEPROM, optical or OM disk such as, for example, CD ROM, DVD ROM, or other disk-type media and compatible disk drive, or any other like memory storage medium and/or device.

It should be appreciated that, given the appropriate inputs, including, but not be limited to, appropriate memories, as generally described above, and/or inputs regarding control of the various elements in the system of FIG. 1 by the processor 221, software algorithms, hardware/firmware circuits, or any combination of software, hardware, and/or firmware control elements may be used to implement the methods shown in FIGS. 6-8, for example.

The computations for establishing the timing of when the bias transfer element engages with the belt and for recalibrating timing of activating the bias transfer element based on the determined timing of the engagement, may be implemented with a circuit in an image processing apparatus itself. Alternatively, such computations may be performed on a programmable general purpose computer, a special purpose computer, a programmed microprocessor or microcontroller, or some form of digital signal processor, peripheral integrated circuit element ASIC or other integrated circuit, or hard-wired electronic or logic circuit such as a discrete element circuit, a programmable logic device such as a PLD, PLA, FGPA or PAL or the like, or may even be manipulated through manual adjustment of one or more of the operating parameters, or coefficients that may be associated with one or more of the operating parameters.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A timing analysis method for an image forming device comprising:

engaging a bias transfer element with a photoconductor such that it is in close proximity to the photoconductor;

applying a voltage to the bias transfer element to cause forward biasing of the bias transfer element;

analyzing an effect caused by the forward biasing;

determining a timing of the engaging between the bias transfer element and the photoconductor based on the analysis;

determining whether the timing of the engaging is within specifications; and recalibrating a system timing for forward biasing the bias transfer element if the engaging is determined to not be within specifications.

2. The method of claim 1, wherein the engaging occurs in an inter-document zone.

3. The method of claim 2, further comprising:

drawing a toner patch on the photoconductor in the inter-document zone; and sensing an edge at which an amount of toner in the toner patch changes, wherein the timing of the engaging is determined based on the location of the sensed edge.

4. The method of claim 2, further comprising:

sensing an edge at which an amount of charge on the photoconductor changes, wherein the timing of the engaging is determined based on the location of the sensed edge.

5. The method of claim 3, wherein the edge indicates a change from the photoconductor being bare to the photoconductor carrying toner, or indicates a change from the photoconductor carrying toner to the photoconductor being bare.

6. The method of claim 1, further comprising:

pulling toner from the photoconductor onto a substrate in a transfer zone;

sensing an edge at which an amount of toner on the substrate changes; and determining the timing of the engaging based on the location of the sensed edge.

7. The method of claim 1, wherein the forward biasing occurs between two instances of reverse biasing the bias transfer element.

8. The method of claim 1, further comprising:

predicting an estimated timing, based on the determined timing of the engaging, of when, in future operation, the bias transfer element would engage with a substrate according to the system timing before recalibration; and recalibrating, based on the estimated timing, the system timing so that the bias transfer element more accurately engages with the substrate only as the substrate passes the bias transfer element.

9. An image processing apparatus comprising:

a processor;

a bias transfer element; and a photoconductor, wherein the processor:

causes an engaging between the bias transfer element and the photoconductor such that the bias transfer element in close proximity to the photoconductor, causes a voltage to be applied to the bias transfer element to cause forward biasing of the bias transfer element, analyzes an effect caused by the forward biasing, determines a timing of the engaging between the bias transfer element and the photoconductor based on the analysis, determines whether the timing of the engaging is within specifications, and recalibrates a system timing for forward biasing the bias transfer element if the engaging is determined to not be within specifications.

10. The image processing apparatus according to claim 9, wherein the engaging occurs in an inter-document zone.

11. The image processing apparatus according to claim 10, further comprising:

a sensor that senses an edge at which an amount of toner in the toner patch changes, wherein the processor determines the timing of the engaging based on the location of the sensed edge, and a toner patch is drawn on the photoconductor in the inter-document zone.

12. The image processing apparatus according to claim 10, wherein:

a sensor senses an edge at which an amount of charge on the photoconductor changes, and the processor determines the timing of the engaging based on the location of the sensed edge.

13. The image processing apparatus according to claim 11, wherein the edge indicates a change from the photoconductor being bare to the photoconductor carrying toner, or indicates a change from the photoconductor carrying toner to the photoconductor being bare.

14. The image processing apparatus according to claim 9, wherein:

the bias transfer element pulls toner from the photoconductor onto a substrate in a transfer zone, a sensor senses an edge at which an amount of toner on the substrate changes, and the processor determines the timing of the engaging based on the location of the sensed edge.

15. The image processing apparatus according to claim 9, wherein the forward biasing occurs between two instances of reverse biasing the bias transfer element.

16. The image processing apparatus according to claim 9, wherein:

the processor predicts an estimated timing, based on the determined timing of the engaging, of when, in future operation, the bias transfer element would engage with a substrate according to the system timing before recalibration, and recalibration of the system timing is based on the estimated timing so that the bias transfer element more accurately engages with the substrate only as the substrate passes the bias transfer element.

17. The image processing apparatus according to claim 9, wherein the image processing apparatus is a xerographic image processing apparatus.

* * * * *